US005092452A

United States Patent [19]

Nakayama

[11] Patent Number: 5,092,452

[45] Date of Patent: Mar. 3, 1992

[54] CHEESE STOCKER

[75] Inventor: Hiroshi Nakayama, Kanazawa, Japan

[73] Assignee: Kabushiki Kaisha Murao and Company, Kanazawa, Japan

[21] Appl. No.: 623,677

[22] Filed: Dec. 6, 1990

[51] Int. Cl.[5] ..... B65G 25/00

[52] U.S. Cl. ..... 198/465.2; 242/35.5 A

[58] Field of Search ..... 198/347.3, 465.1, 465.2; 242/35.5 A

[56] References Cited

U.S. PATENT DOCUMENTS 3,642,158 2/1972 Koennecke et al. ..... 198/465.1 X
3,788,054 1/1974 Haussmann et al. ..... 198/347.3 X
4,690,342 9/1987 Langen ..... 242/35.5 A

*Primary Examiner*—Joseph E. Valenza
*Assistant Examiner*—Keith L. Dixon
*Attorney, Agent, or Firm*—Oblon, Spivak, McClelland, Maier & Neustadt

[57] ABSTRACT

The present invention relates to a cheese stocker for temporarily storing cheeses doffed by a winder, wherein the cheeses are placed on a cheese conveyor through trays to prevent the surface of the cheese from occurrence of mechanical damage or stain, wherein the cheeses are transferred and conveyed by a cheese conveyor, a tray conveyor, a traverser and a transfer machine, and wherein a plurality of stockers are provided along the cheese conveyor to thereby render possible prior-in and post-out conveyance to cheeses between the stockers.

9 Claims, 8 Drawing Sheets

CHEESE STOCKER

BACKGROUND OF THE ART

This invention relates to a cheese stocker for temporarily storing cheeses doffed by a winder in a spinning mill.

In spinning mills, sometimes, winders are operated night and day and an exclusive-use cheese stocker is used for temporarily storing a large quantity of cheeses doffed by the winders. The storing of cheese by the cheese stocker not only results in the continuous provision of production performance of the winders but also is every effective in efficiently carrying out the packing work or the like in the subsequent steps.

The cheese stocker can take-in a predetermined number of cheeses to temporarily house them therein and can take them out as needed. As one example of the conventional apparatus, apparatus has been known in which cheeses are taken onto a cheese conveyor, and the cheese conveyor is temporarily stopped, after which a pair of plates disposed along opposite sides of the cheese conveyor are moved up and down to scoop-up and transfer the cheeses onto the pair of plates, and the cheeses are held on the plates and stored. The spacing between the plates is formed to be wider than the width of the cheese conveyor and narrower than the diameter of a cheese. If the plates are provided in multi-stage in a vertical direction, a storing quantity of cheeses can be increased. On the other hand, in taking-out cheeses, the plates are moved down to re-transfer the cheeses onto the cheese conveyor, after which the cheese conveyor is actuated to take them out.

In such a cheese stocker as described above, the control or management of the frame of the winder and kinds of the goods has been carried out by using the plates while being divided stage by stage.

According to the aforementioned prior art, the cheeses are loaded on the cheese conveyor in row and taken into the cheese stocker. That is, since the cheeses are loaded directly on the cheese conveyor, the surface of the cheeses was liable to be mechanically damaged. Furthermore, since the control of the frame of the winder and kinds of the goods depends on separate control by the plates and the plates need be relatively moved up and down along the opposite sides of the cheese conveyor, the cheeses are necessary to be stored orderly from the upper stage to the lower stage whereas the cheeses are necessary to be taken out orderly from the lower stage. Accordingly, there was a problem that the control of cheeses stored stage by stage is effected by unit of stage, only so-called prior-in and post-out operation can be done.

OBJECT OF THE INVENTION

A primary object of the present invention is to prevent cheeses from being damaged due to the taking-in and out to present the cheeses from occurrence of cutting or stain.

A second object of the present Invention to provide a cheese stocker in which the control of the frame of the winder and kinds of the goods can be individually and positively carried out and the cheeses can be taken in and out in the manner of prior-in and post-out operation.

DISCLOSURE OF THE INVENTION

For achieving the aforesaid objects, this invention has a configuration in which is provided with a cheese conveyor for moving cheeses through trays and formed therein with cheese shelves of an elevating type and multi-stage form, and comprising a plurality of stockers disposed along the cheese conveyor, a tray conveyor juxtaposed to the cheese conveyor to return empty trays, and a traverser for connecting ends of the cheese conveyor and tray conveyor.

The cheese conveyor and tray conveyor may be provided with a stopper mechanism.

Figure 2:
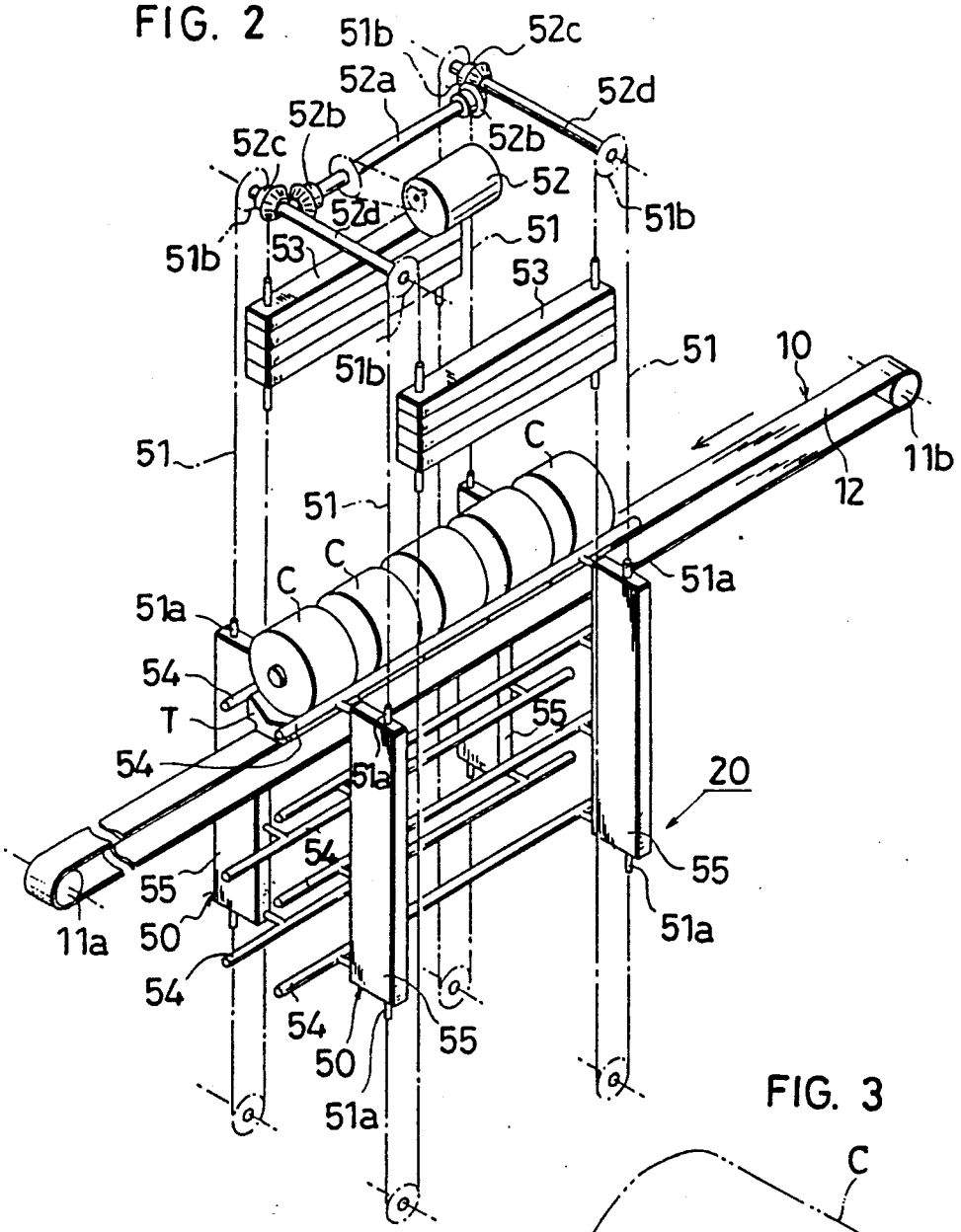
Figure 3:
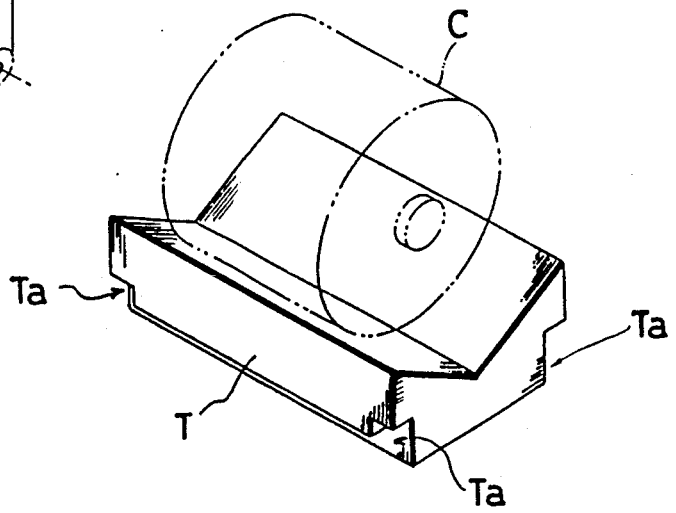
Figure 4:
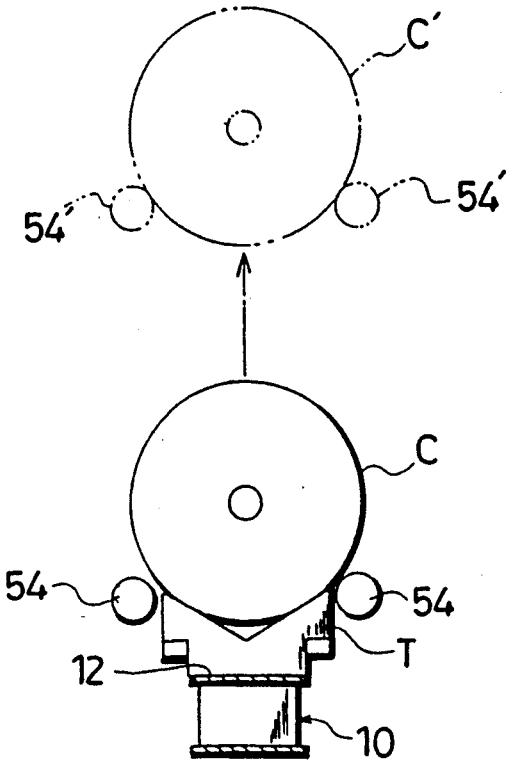
Figure 5:
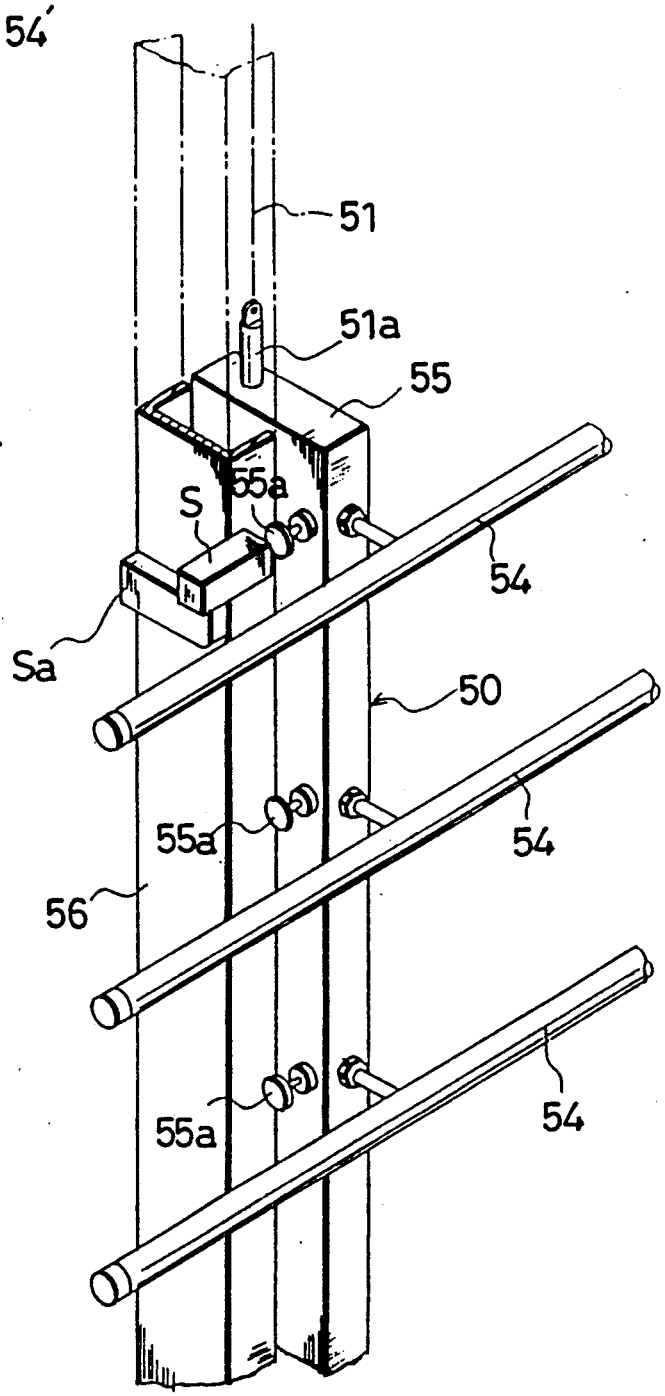
Figure 7:
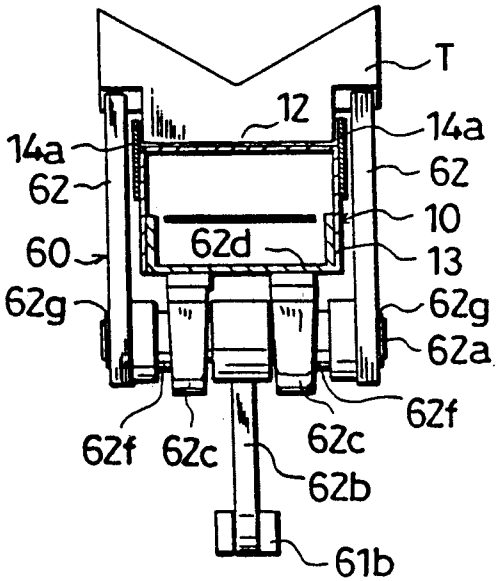
Figure 6:
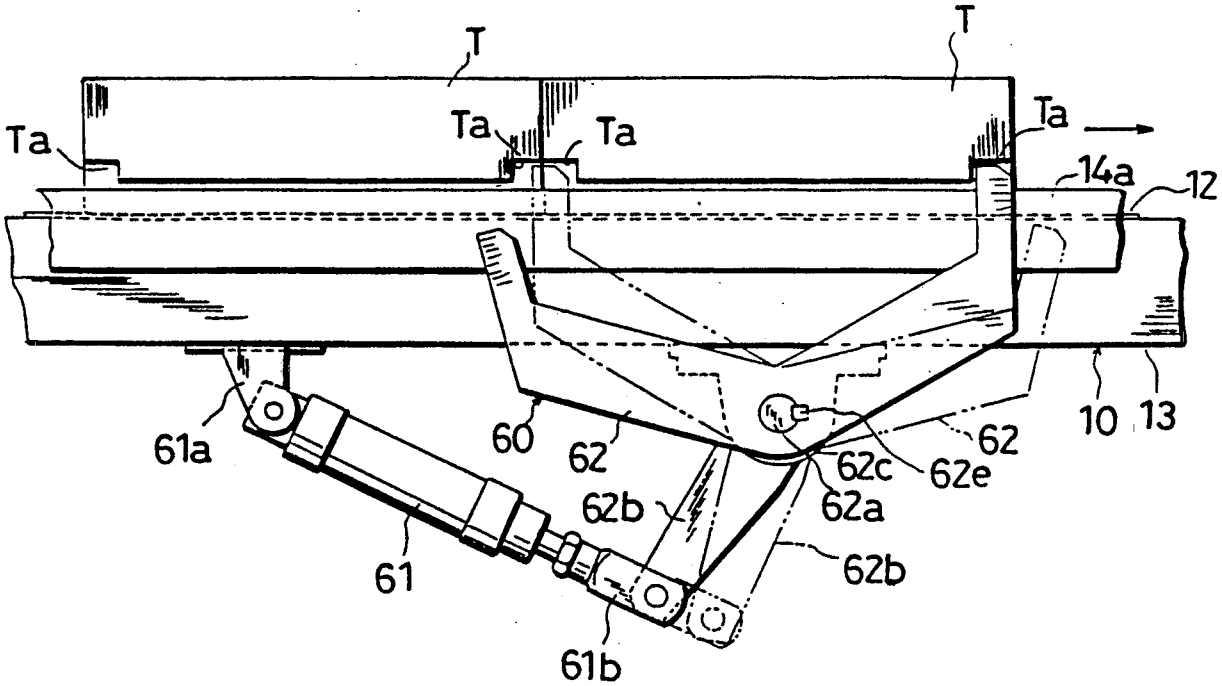
Figure 8:
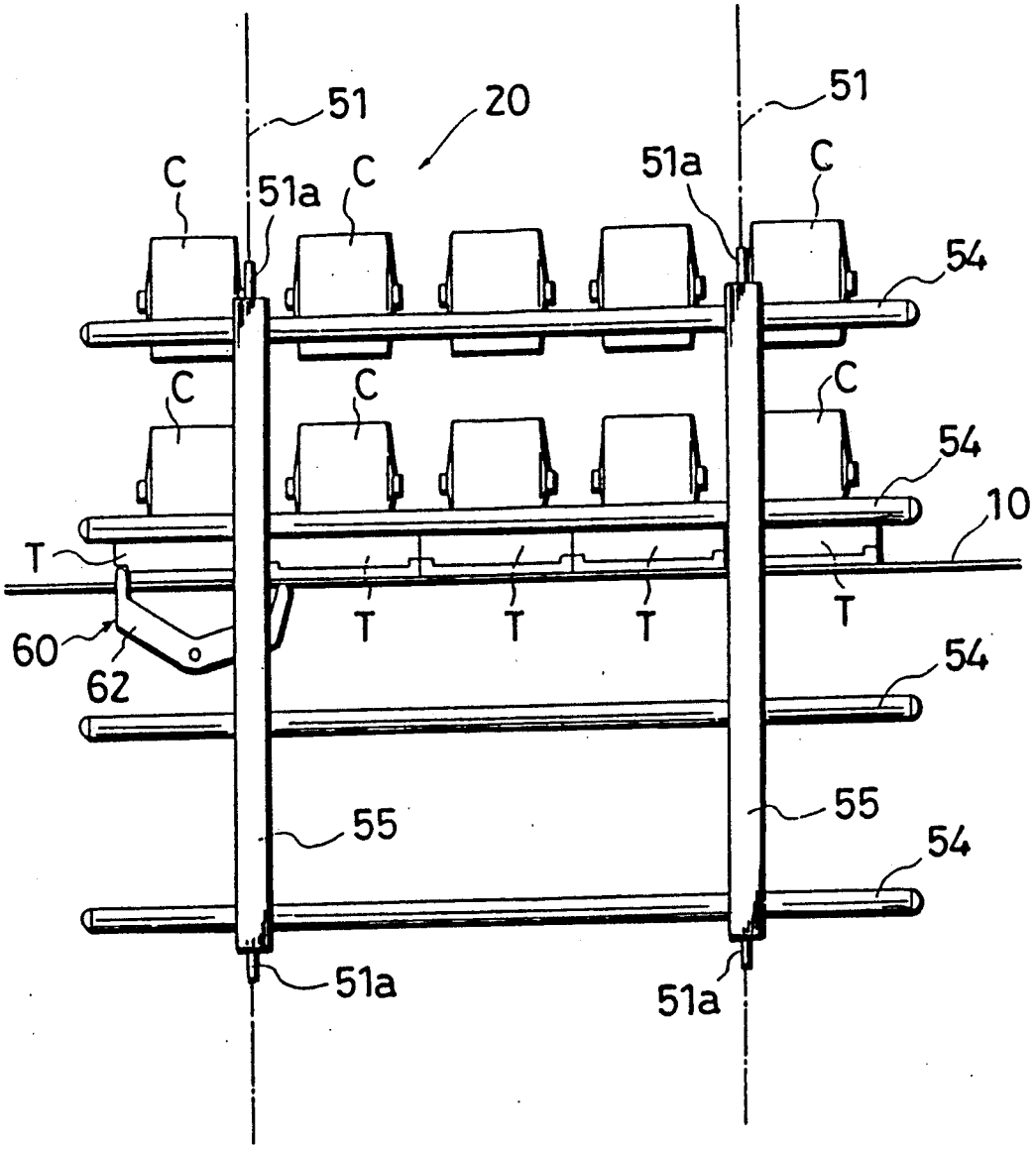
Figure 9:
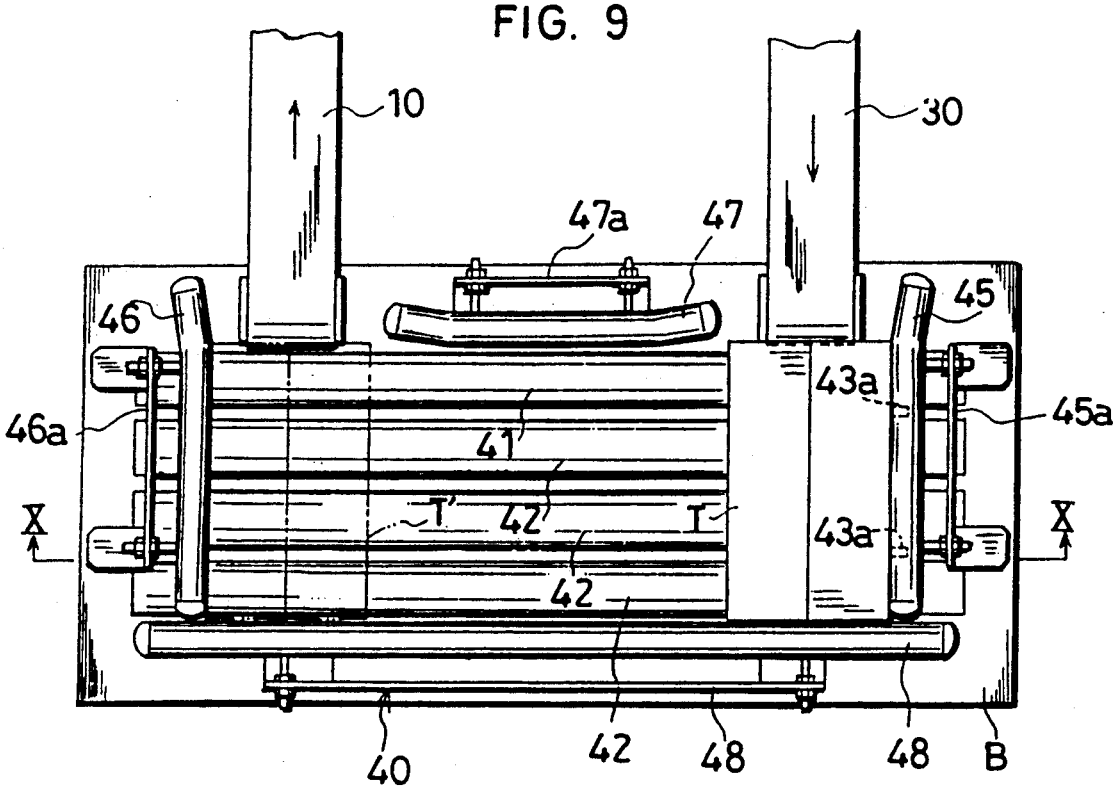
Figure 10:
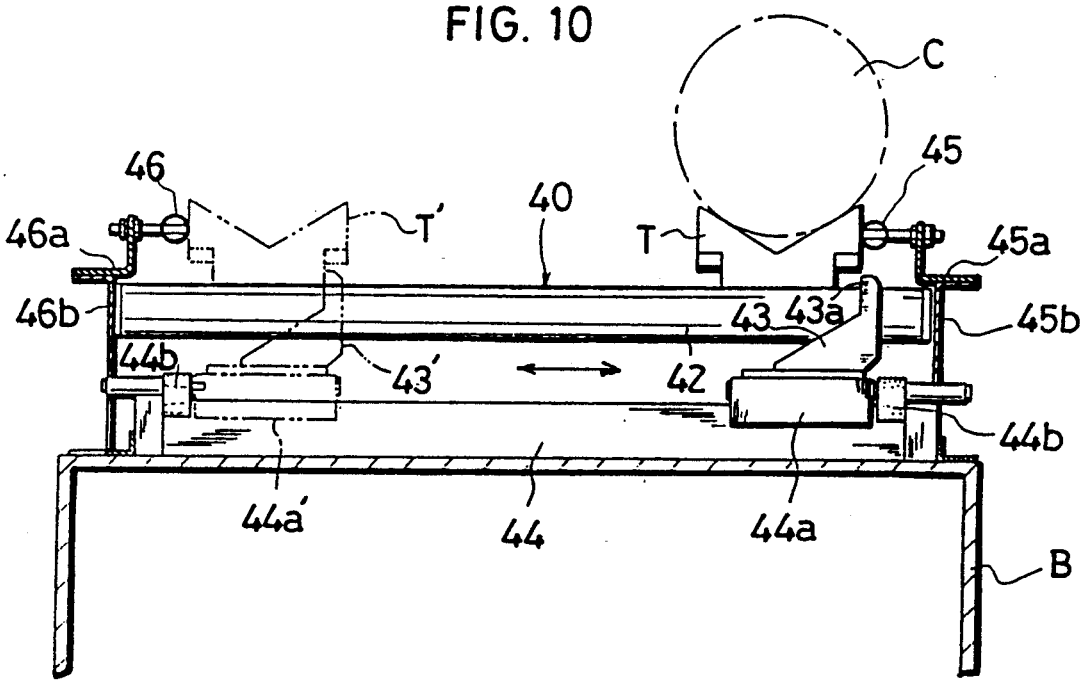
Figure 11:
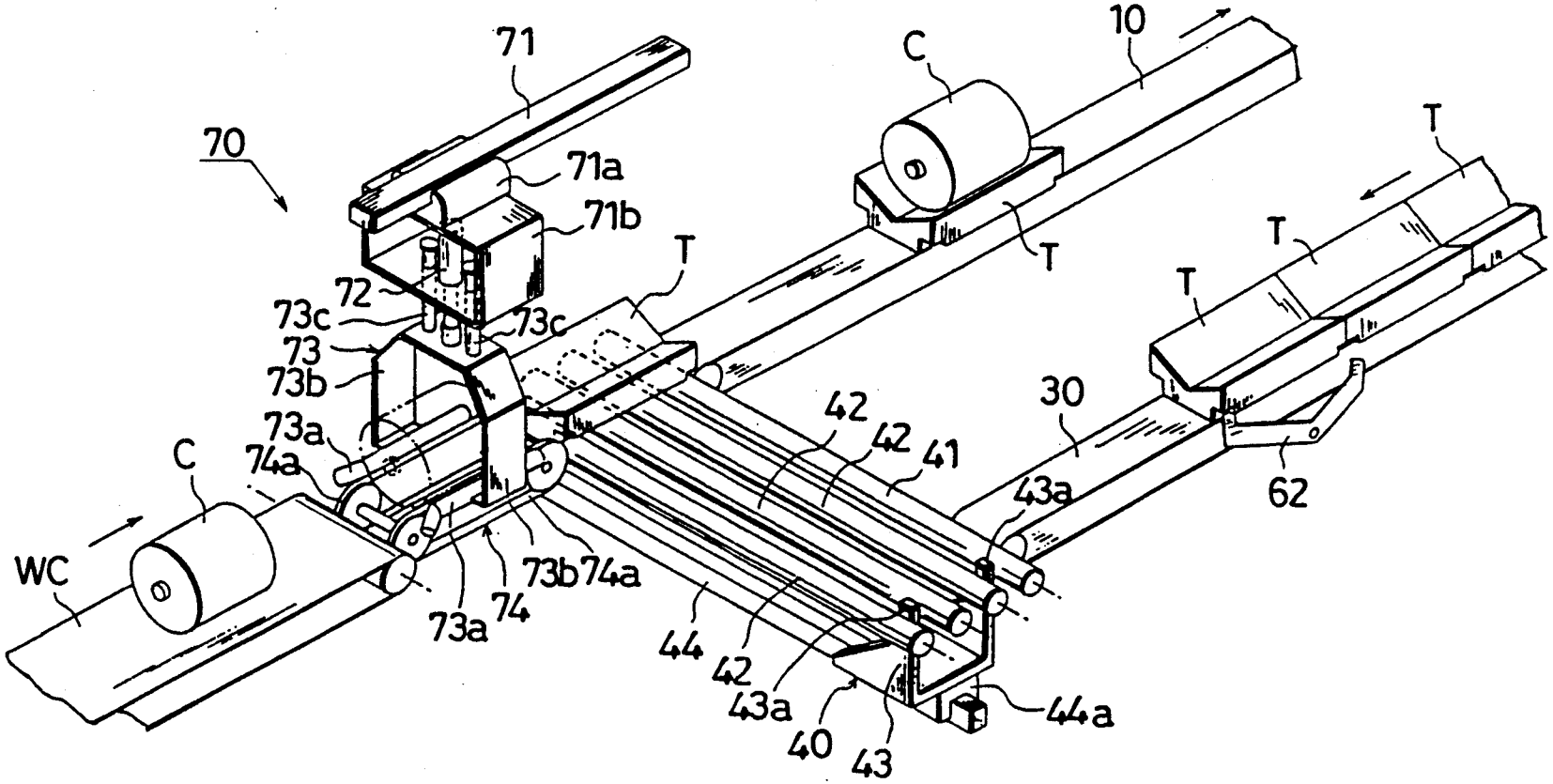
Figure 12:
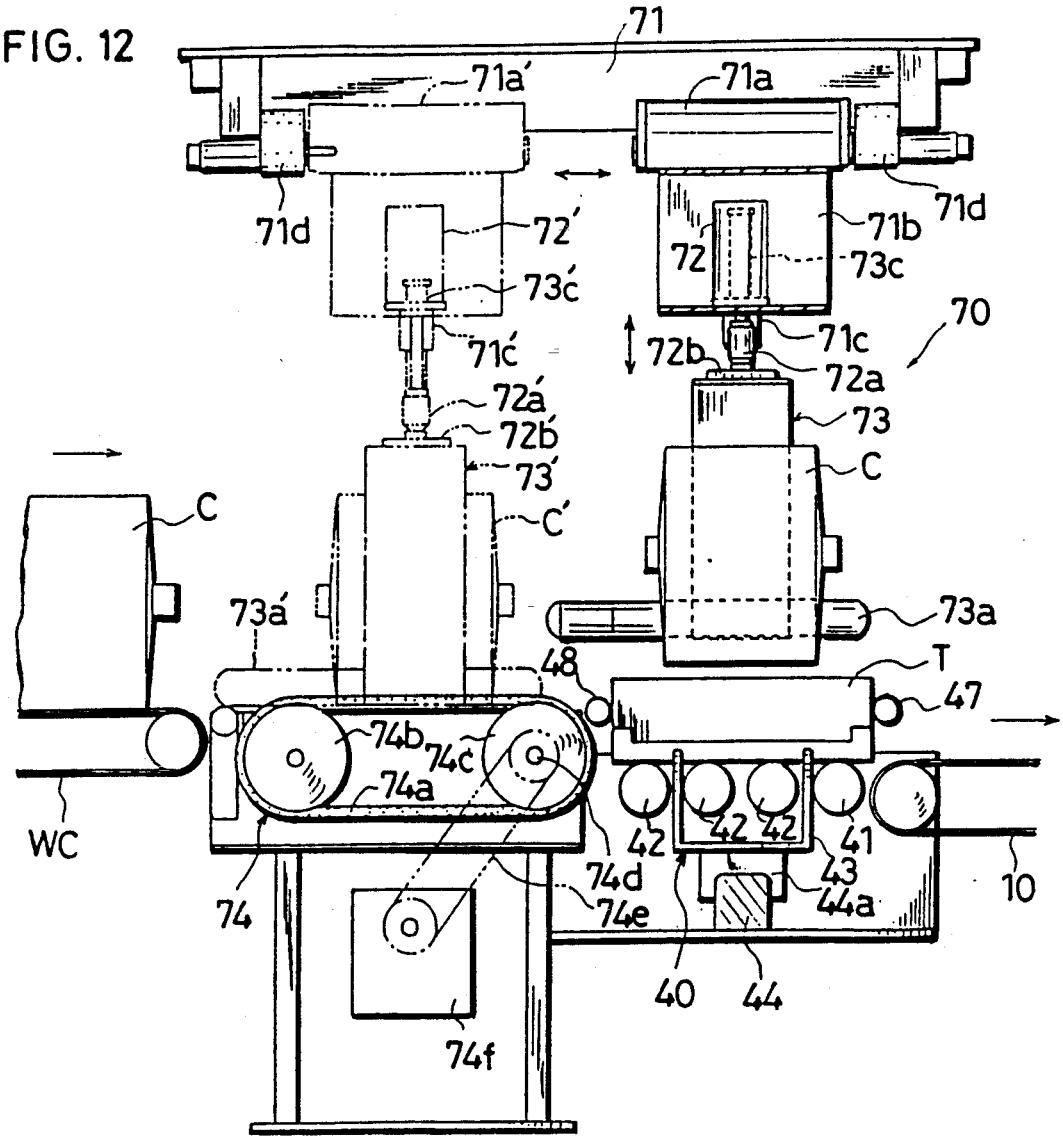
Figure 13:
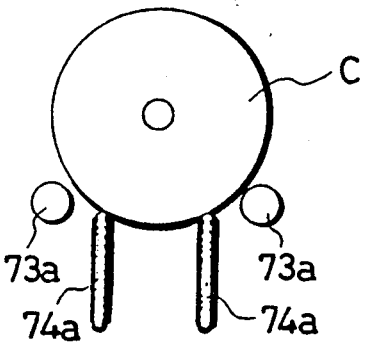
Figure 14:
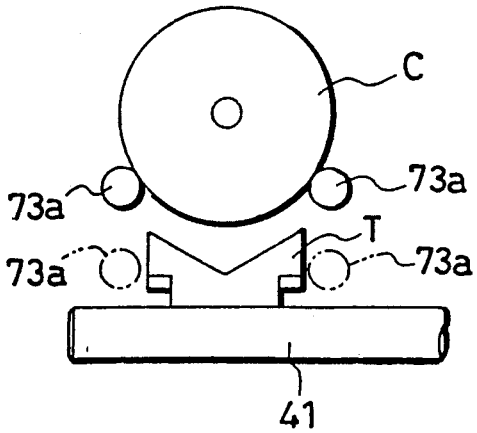

FIG. I is an overall plan view;

FIG. 2 is an explanatory view in perspective of a stocker;

FIG. 3 is a perspective view of a tray;

FIG. 4 is an explanatory view of the operation of the stocker;

FIG. 5 is an enlarged perspective view of essential parts of the stocker;

FIG. 6 is a side view of a stopper mechanism;

FIG. 7 is a front view of the stopper mechanism shown in FIG. 6;

FIG. 8 is a side view of the stocker;

FIG. 9 is a plan view of a traverser;

FIG. 10 is a sectional view taken on line X—X of FIG. 9;

FIG. 11 is an explanatory view in perspective of a transfer machine and a traverser;

FIG. 12 is an explanatory view in side of the transfer machine;

and FIGS. 13 and 14 are explanatory views of the operation of the transfer machine shown in FIG. 12.

C . . . cheese, and T . . . tray.

DETAILED DESCRIPTION OF THE INVENTION

Representative embodiments of the present invention will now be described in detail with reference to the drawings.

Figure 1:
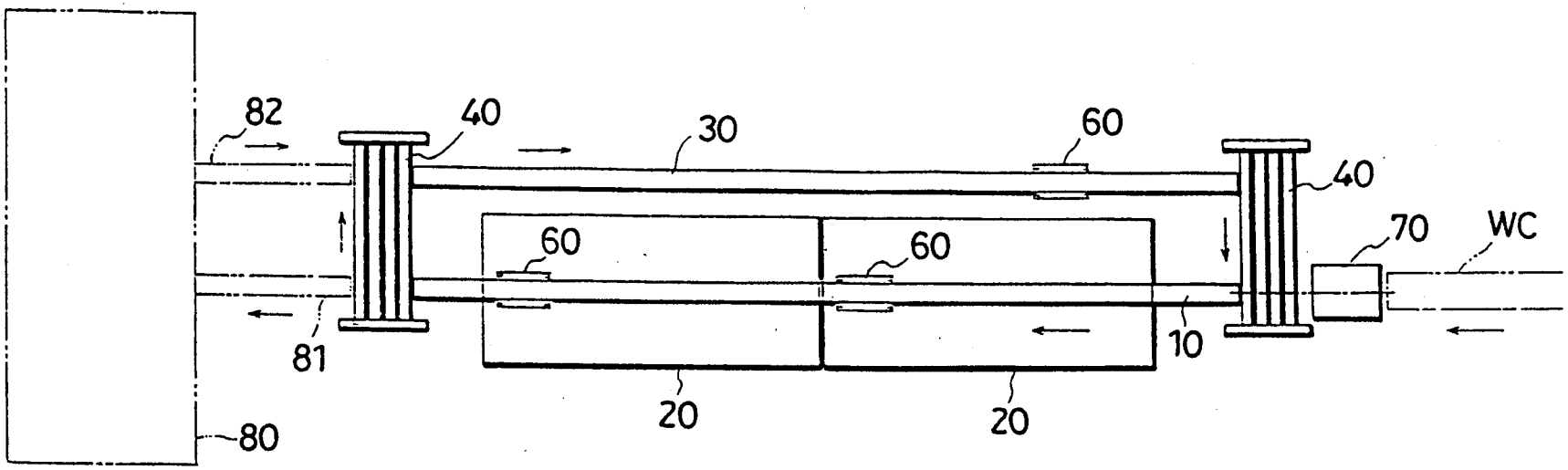
FIGS. 1 through 14 show embodiments of the present invention.

The cheese stocker comprises, as shown in FIG. 1, a cheese conveyor 10, two blocks of stockers 20 and 20, a tray conveyor 30 and traversers 40 and 40.

The cheese conveyor 10 is a conveyor line of a general belt type as shown in FIGS. 2 and 7, in which a main pulley 11*a* and a driven pulley 11*b* are disposed on both ends of a channel-like frame 13 opened downwardly, the conveyor side of a conveyor belt 12 is placed on the upper surface of the frame 13, and the conveyor belt 12 is passed over the main pulley 11*a* and the driven pulley 11*b*. Guide plates 14*a* and 14*a* defining the side edge of the conveyor belt 12 are fixedly mounted on both sides of the frame 13.

Cheeses C are placed on the cheese conveyor 10 through a tray T (FIG. 2). That is, as shown in FIG. 7, the tray T has the upper surface inclined in the shape of T both sides of the lower surface cut so as to meet the guide plates 14*a* and 14*a* of the cheese conveyor 19, and four corners (front and rear ends of the cut) on the lower surface formed with recesses Ta, Ta . . . as shown in FIG. 3.

The cheese conveyor 10 extends through the intermediate portion of the stockers 20 and 20 as shown in FIG.

2. Each of the stockers 20 has elevating type multi-stage cheese shelves 50 and 50 on both sides of the cheese conveyor 10, each cheese shelf 50 being configured so that endless chains 51 and 51 are connected to a pair of cheese shelf bodies 55 and 55 through mounting pins 51*a*, 51*a* . . . and the shelves can be moved up and down by a common motor 52 through the chains 51 and 51. A counterweight 53 is attached to the chains 51 and 51. Between the motor 52 and sprockets 51*b*, 51*b* . . . for driving the chains 51, 51 . . . is interposed a power transmission mechanism such as a bevel gear mechanism comprising a shaft 52*a*, bevel gears 52*b*, 52*b*, 52*c*, 52*c*, and shafts 52*d*, 52*d*.

Support rods 54, 54 . . . are provided in a multi-stage form on the opposed side in the cheese shelf bodies 55, 55 . . . with the cheese conveyor 10 sandwiched therebetween, the spacing between the pair of opposed support rods 54 and 54 being wider than the width of the cheese conveyor 10 and smaller than the diameter of the cheese C. Accordingly, when the cheese shelves 50, 50 are moved upward, cheeses C, C. . . on the trays T, T . . . can be transferred from the cheese conveyor 10 to the pair of support rods 54 and 54 as shown in FIG. 4. On the other hand, when the cheese shelves 50 and 50 are moved downward, the cheeses C, C . . . can be transferred from the support rods 54 and 54 onto the cheese conveyor 10.

The cheese shelf bodies 55, 55 . . . are disposed so that they ma be moved up and down along the guide member 56 as shown in FIG. 5. A proximity sensor S is mounted on a single guide member 56 through a mounting block Sa. When the cheese shelf body 55 is at its lowermost position, the proximity sensor S is mounted at a position which is substantially the same height as that of the support rod 54. On the cheese shelf body 55 are provided dogs 55*a*, 55*a* . . . at the same height as each of the support rods 54. Accordingly, the proximity sensor S can response to the dogs 55*a*, 55*a* . . . corresponding to the support rods 54, 54 . . . to thereby sense what stage of the pair of support rods 54, 54 positioned on both sides of the cheese conveyor 10 is. It is to be noted that a plurality of proximity sensors S are provided corresponding to the support rods 54, 54 at each stage, and the dog 55*a* may be provided merely at a position corresponding to the support rods 54, 54 at the lowermost stage.

The tray conveyor 30 is disposed parallel with the cheese conveyor 10, the conveyor direction thereof being set reversely. It is to be noted that the tray conveyor 30 may be of the same type as the cheese conveyor 10.

Stopper mechanisms 60, 60 . . . shown in FIG. 6 are provided at tray stop positions of the cheese conveyor 10 and the tray conveyor 30 as shown in FIG. 1. The stopper mechanism 60 has a cylinder 61 which is expanded whereby a pair of U-shaped arms 62, 62 are reciprocatingly swung (FIGS. 6 and 7). The cylinder 61 is pivotably mounted through a bracket 61*a* on the lower surface of a support member 62*d* provided at the lower portion of the frame 13 of the cheese conveyor 10, for example. The cylinder 61 has a rod pivotably connected to the extreme end of a lever 62*b* through a connecting means 61*b*. The lever 62*b* is secured to the intermediate portion of a shaft 62*a* rotatably mounted through bearings 62*c* and 62*c* on the lower surface of the support member 62*d*, the arms 62, 62 being secured to both ends of the shaft 62*a*. The arms 62, 62 are secured to the shaft 62*a* through a key 62*e*, spacers 62*f*, 62*f* are disposed between the bearings 62*c* and 62*c*, and both side ends thereof are located by stop rings 62*g* and 62*g*.

The arms 62 and 62 can be pivotally moved whereby their extreme ends are alternately projected on the conveyor surface of the cheese conveyor 10 to alternately engage and disengage from either recesses Ta, Ta . . . before and behind the tray T on the cheese conveyor 10 (as indicated at the solid line and phantom line in FIG. 6). Accordingly, the arms 62 and 62 can be pivotally moved to thereby separate the trays T, T . . . one by one and eject them downstream.

On the other hand, both the ends of the tray conveyor 30 and the cheese conveyor 10 are connected through traversers 40 and 40 as shown in FIG. 1.

As shown in FIGS. 9 and 10, the traverser 40 has a single drive roller 41 and several rotatable driven rollers 42, 42 . . . arranged perpendicular to the cheese conveyor 10 and the tray conveyor 30, and has a traverser body 43 for moving trays on the drive roller 41 and driven rollers 42, 42 . . . The drive roller 41 is connected to a motor not shown and can be driven normally and reversely. The traverser 43 is linearly reciprocatingly driven through a movable table 44*a* by a rodless cylinder 44. The traverser 43 has projections 43*a* and 43*a* projected upwardly of the driven rollers 42, 42 . . ., said projections being catched by the lower side of the tray T. Dampers 44*b* and 44*b* for absorbing horizontal shocks of the movable table 44*a* are mounted on both ends of the rodless cylinder 44. Guide rods 45 and 46 for guiding the trays T in the moving direction of the cheese conveyor 10 and tray conveyor 30 and guide rods 47 and 48 for guiding the trays T in a longitudinal direction of the drive roller 41 are adjustably in position disposed on a mount B through mounting means 45*a*, 45*b*, 46*a*, 46*b*, 47*a* and 48*a*.

A transfer machine 70 shown in FIGS. 11 and 12 is disposed at upstream of the cheese conveyor 10 and further upstream of the traverser 40.

The transfer machine 70 comprises a rodless cylinder 71 disposed parallel to and horizontal to the cheese conveyor 10, a vertically stood air cylinder 72, a cheese carrier and a short and round belt conveyor 74. The air cylinder 72 is vertically mounted on a movable table 71*a* of the rodless cylinder 71 through a support frame 71*b*. The cheese carrier 73 has a pair of downward arms 73*b* and 73*b*obtained by bending a plate into an inverted-U shape, said arms 73*b* and 73*b* being provided at the lower ends with carrier rods 73*a* and 73*a* to support cheeses C thereon as shown in FIG. 14. The cheese carrie 73 is connected to the rod of the air cylinder 72 through the mounting brackets 72*a* and 72*b* as shown in FIG. 12. Guide rods 73*c* and 73*c* are stood upright on the upper surface of the cheese carrier 73, said guide rods 73*c* and 73*c* slidably extending through bushes 71*c* and 71*c* secured to the support frame 71*b*. Dampers 71*d* and 71*d* are mounted on both ends of the rodless cylinder 71.

A round belt conveyor 74 is configured so that a pair of round belts 74*a* and 74*a* disposed parallel with each other are passed over driven pulleys 74*b* and 74*b* and drive pulleys 74*c* and 74*c*, and a drive shaft 74*d* is connected to a motor 74*f* through a chain 74*e*. The round belt conveyor 74 can support cheeses C on the pair of round belts 74*a* and 74*a* as shown in FIG. 13.

Accordingly, cheeses C, C . . . conveyed from the winder are taken one by one onto the round belt conveyor 74 of the transfer machine 70 by means of a conveyor WC as shown in FIG 12. At that time, the cheese carrier 73 is moved down on the round belt conveyor 74 by the rodless cylinder 71 and the air cylinder 72 (see the phantom line of FIG. 12). When the air cylinder 72 is contracted to move the cheese carrier 73 upward, the cheese C can be raised by the carrier rods 73*a* and 73*a*, the cheese carrier 73 is then moved onto the traverser 40 by the rodless cylinder 71 (the solid line of FIG. 12), and the air cylinder 72 is extended to place the cheese C on the empty tray T which is at standby on the traverser 40.

Subsequently, the drive roller 41 of the traverser 40 is rotated to deliver the cheeses C as well as the trays T onto the cheese conveyor 10, and the cheese carrier 73 is returned to its original position. If this operation is repeated, the cheeses C, C . . . on the conveyor WC can be placed one by one o the trays T to deliver them onto the cheese conveyor 10. Here, the empty trays are inserted into the traverser 40 from the tray conveyor 30 as shown in FIG. 11, and the empty trays are sequentially taken into a predetermined position by the traverser body 43.

The cheese C on the tray T delivered onto the cheese conveyor 10 is stopped by the stopper mechanism 60 located at the side end downstream of the stocker 20 adapted to receive the cheeses as shown in FIG. 8. It is necessary that the stopper mechanism 60 located near the terminal of the cheese conveyor 10 moves the trays T, T . . . individually one by one and separately downstream whereas the stopper mechanism provided on the stocker 20 at upstream may be configured to merely allow stop or pass the flow of continuous trays T, T . . .

When the cheeses C, C . . . for one stage portion of the stocker 20 are stopped by the stopper mechanism 60, the cheese shelves 50 and 50 are moved upward by one stage portion as shown in FIG. 2 to transfer the cheeses C, C . . . at one onto the support rods 54 and 54. The cheese shelves 50 and 50 can be moved upward one by one when the proximity sensor S senses the dog 55*a* lower by one stage as the cheese shelf bodies 55, 55 . . . move upward (FIG. 5). In this manner, the cheeses C, C . . . can be stored in all stages of the predeterimed stocker 20.

On the other hand, the empty trays T, T . . . are conveyed onto the tray conveyor 30 through the downstream traverser 40 and stands-by, and are used, as necessary, to place new cheeses C, C . . . by the transfer machine 70 via the upstream traverser 40.

In ejecting the trays T, T . . . from the cheese conveyor 10 and tray conveyor 30 to the traversers 40 and 40, the stopper mechanisms 60 and 60 are effectively operated and the arms 62 and 62 are slidably moved to separate the trays T, T . . . one by one and orderly eject them one by one onto the traversers 40 and 40.

All of the cheeses C, C . . . within the stocker 20 can be ejected by placing and preparing empty trays T, T . . . corresponding in number to one stage portion on the cheese conveyor 10 and moving down the cheese shelves 50 and 50 one by one.

Since the storing and ejection of the cheeses C, C . . . with respect to the stockers 20 and 20 can be carried out randomly from either stockers 20 and 20, the cheeses C, C . . . stored in the stockers 20 and 20 can be handled by the prior-in post-out operation with the stocker 20 as a unit. That is, the cheeses C, C . . . are classified according to the frame of the winder and kinds of the goods with the winder 20 as a unit whereby suitable kinds of cheeses C can be ejected in accordance with !he processing of subsequent steps such as inspection, packing, etc.

In the above-described explanation, a suitable number of cheese shelves 50 and 50 in one stocker 20 can be set. That is, in the FIG. 8 example is shown 5 pcs ×4 stages of cheeses C, C . . . stored but preferably, N=m pcs×n stages is used, and the total storing number N is adjusted to the number of drums of a winder or more. It is further noted that two or more suitable blocks of the stockers 20 and 20 arranged along the cheese conveyor 10 may be used.

The conveyor WC connected to the winder may be of a general conveyor line installed on the floor but may be of a so-called ceiling type cheese conveyor line.

The cheeses C, C . . . ejected onto !he traverser 40 at downstream of the cheese conveyor 10 are further conveyed to an inspection and packing site 80. Empty trays T, T when cheeses C, C . are stored in the stockers 20, 20 are returned to the tray conveyor 30 by the traverser 40 whereas as shown in FIG. 1, a conveyor 81 is provided on the cheese conveyor 10 side of the traverser 40 so that the cheeses C, C . . . placed on the trays T, T . . . may be conveyed to the inspection and packing side 80. At that time, the empty trays T, T . . . are returned from the inspection and packing site 80 to the conveyor 82 and returned to the tray conveyor 30 and stands-by.

As described above, according to the present invention, the cheese conveyor for conveying cheeses through trays, the plurality of stockers having multi-stage type cheese shelves, the tray conveyor, the traverser and the transfer machine can be combined so that the cheeses may be always conveyed while being placed on the trays. Therefore, the damage of the cheeses can be minimized and the stains or cuts of the cheeses disappeared. Furthermore, a plurality of stockers are provided along the cheese conveyor and each stocker independently stores and ejects cheeses, and therefore, there provides an extremely excellent effect that the control by classification such as the frame of the winder and kinds of the goods can be carried out by the prior-in and post-out operation with the stocker as a unit.

What is claimed is:

1. A cheese stocker for temporarily storing doffed cheeses, comprising:

a cheese conveyor disposed in a horizontal direction to convey cheeses through trays;

a plurality of stockers which is of an elevating type and provided with multi-stage type cheese shelves along said cheese conveyor;

a tray conveyor provided parallel with said cheese conveyor to return empty trays;

traversers disposed on ends of said cheese conveyor and said tray conveyor to transfer trays between the conveyors; and a transfer means for placing cheeses on the empty trays, said transfer means being provided on the traverser provided upstream of said cheese conveyor.

2. A cheese stocker for temporarily storing doffed cheeses, comprising:

a cheese conveyor disposed in a horizontal direction to convey cheeses through trays;

a plurality of stockers which is of an elevating type and provided with multi-stage type cheese shelves along said cheese conveyor;

a tray conveyor provided parallel with said cheese conveyor to return empty trays and a stopper mechanism provided at a downstream position of each stocker in said cheese conveyor and said tray conveyor;

traversers disposed on ends of said cheese conveyor and said tray conveyor to transfer trays between the conveyors, and a transfer machine for placing cheeses on the empty trays, said transfer machine being provided on the traverser provided upstream of said cheese conveyor.

3. A cheese stocker according to any of claims 1 or 2, wherein said tray is formed in its upper surface with a V-shape, said tray being formed in its both sides of the bottom with cuts in a longitudinal direction, said cut being formed in its upper front and rear portions with recesses.

4. A cheese stocker according to any of claims 1 or 2, wherein a pair of guide plates, spacing between which is slightly wider than a width of the bottom surface of the tray, are provided on both sides of said cheese conveyor.

5. A cheese stocker according to any of claims 1 or 2, wherein a pair of guide plates, spacing between which is slightly wider than a width of the bottom surface of the tray, are provided opposedly on both sides of said tray conveyor.

6. A cheese conveyor according to any of claims 1 or 2, wherein said stocker comprises a pair of support rods faced parallel with both sides of the cheese conveyor and a cheese shelf body for vertically arranging and connecting said support rods, said cheese shelf bodies opposed to sandwich said cheese conveyor therebetween being connected to a single motor through a power transmission mechanism, the support rod paired in a horizontal direction being disposed movably up and down.

7. A cheese stocker according to any of claims 1 or 2, wherein said traverser has a drive roller and a driven roller over which ends of said cheese conveyor and said tray conveyor are passed, said drive roller and said driven roller being disposed perpendicular to the moving direction of said conveyors, said drive roller being rotated normally and reversely, and a traverser body which moves along an axial longitudinal direction of said drive roller is disposed so that a part thereof projects from the top of each of said rollers.

8. A cheese stocker according to any of claims 1 or 2, wherein said transfer machine comprises a pair of round belt conveyors placing cheeses one by one thereon and a cheese carrier for supplying the loaded cheeses to empty trays, said cheese carrier being formed into an inverted-U shape and having at the extreme end thereof a pair of carrier rods opposed in a spaced relation smaller than the diameter of the cheese, said cheese carrier being connected to an expansion cylinder and being movable up and down, said cheese carrier having a rodless cylinder connected thereto to horizontally reciprocate said cheese carrier.

9. A cheese stocker according to claim 2, wherein said stopper mechanism comprises a U-shaped arm having an extreme end formed to have substantially the same spacing as the longitudinal length of the tray and an expansion cylinder supported on a part of said arm, said arm being pivotably supported substantially in the central portion between said extreme ends.

* * * * *